US006151842A

United States Patent [19]

Hododi

[11] Patent Number: 6,151,842

[45] Date of Patent: Nov. 28, 2000

[54] SET OF STRUCTURAL ELEMENTS FOR CONSTRUCTIONS MADE OF "DURREF" MATERIAL AND SPACE SELF SUPPORTED MODULE REALIZED WITH THIS

[76] Inventor: Andrei Hododi, Calea Serban Voda No. 270-14, Apt. 64, R-75207 Bucharest, Romania

[21] Appl. No.: 09/029,149

[22] PCT Filed: Aug. 27, 1996

[86] PCT No.: PCT/RO96/00008

§ 371 Date: Feb. 27, 1998

§ 102(e) Date: Feb. 27, 1998

[87] PCT Pub. No.: WO97/08402

PCT Pub. Date: Mar. 6, 1997

[30] Foreign Application Priority Data

Aug. 28, 1995 [RO] Romania ..... 95-01519

[51] Int. Cl.[7] ..... E04B 2/10; E04B 1/02

[52] U.S. Cl. ..... 52/79.8; 52/574; 52/592.1; 52/592.6; 52/603; 52/608

[58] Field of Search ..... 52/79.8, 223.6, 52/223.7, 592.1, 592.2, 592.3, 592.6, 569, 572, 574, 414, 425, 431, 603–609

[56] References Cited

U.S. PATENT DOCUMENTS

| | | | |
|---|---|---|---|
| 991,896 | 5/1911 | Sajo | 52/592.1 X |
| 1,431,530 | 10/1922 | Leicester | 52/608 |
| 1,562,728 | 11/1925 | Albrecht | 52/607 |
| 2,184,714 | 12/1939 | Freeman | 52/592.1 X |
| 2,994,162 | 8/1961 | Frantz | 52/605 X |
| 3,305,982 | 2/1967 | Steele | 52/608 |
| 4,010,579 | 3/1977 | Galvagni | 52/79.8 |
| 4,041,670 | 8/1977 | Kaplan | 52/592.2 |
| 4,228,623 | 10/1980 | Menosso | 52/79.3 |
| 4,268,317 | 5/1981 | Rayl | 106/98 |
| 4,314,431 | 2/1982 | Rabassa | 52/259 |
| 4,726,567 | 2/1988 | Greenberg | 52/223.7 X |
| 4,794,749 | 1/1989 | Marcel | 52/592.1 X |
| 5,502,088 | 3/1996 | Hododi | 524/34 |

FOREIGN PATENT DOCUMENTS

| | | |
|---|---|---|
| 414 612 | 9/1910 | France . |
| 1 277 974 | 10/1961 | France . |
| 2 110 563 | 9/1972 | Germany . |
| WO 93/12179 | 6/1993 | WIPO . |

*Primary Examiner*—Carl D. Freidman
*Assistant Examiner*—Winnie Yip
*Attorney, Agent, or Firm*—Herbert Dubno

[57] ABSTRACT

Structural elements for the production of self-supporting structures are composed of a composition containing mineral and organic components and molded in modular structural shapes including a cube of side length L having vertical and horizontal holes traversed by threaded rods, a fork-shaped element, a Z-shaped element and a lintel element with projections of a width equal to L/3. The entire structure is held together by interfitting the projections and gaps between projections and with the threaded rods.

5 Claims, 2 Drawing Sheets

SET OF STRUCTURAL ELEMENTS FOR CONSTRUCTIONS MADE OF "DURREF" MATERIAL AND SPACE SELF SUPPORTED MODULE REALIZED WITH THIS

CROSS REFERENCE TO RELATED APPLICATIONS

This application is a national stage of PCT/RO96/0008 filed Aug. 27, 1996 and based, in turn, on Romanian national application 95-01579 of Aug. 28, 1995 under the International Convention.

TECHNICAL FIELD

The invention relates to a set of structural elements for constructions made of "DURREF" material meant for making space selfsupported modules of varied types and shapes, in a modular system. By adapting its form and dimensions this set may be applied in making housing constructions with several stages, as well as industrial and agrozootechnical constructions such as: fabrication and execution halls, storehouses, wine and underground tunnels, silos, animal shelters, wine cellars and other constructions meant for production. Due to feasibility and adaptability of the constructive concept, and to the physical characteristics of the special materials used according to the Romanian Patent No. RO-A-105789 (corresponding to U.S. Pat. No. 5,502,088 of Mar. 26, 1996), known under the name of DURREF, the set of structural elements according to the invention may be used also in special constructions, such as: airraid shelters, atomic- radiation shelters, chemical shelters, as well as construction with a high degree of antiseismic surety and invulnerability to seismic action.

BACKGROUND OF THE INVENTION

There are known prefab structural elements meant for housing constructions. They are provided in the shape of cubes with a lower surface meant for a floor, an upper surface meant for a ceiling and at least two lateral surfaces meant for walls. Such a cubic element can represent a quarter of the volume of a room and, by being assembled with other three similar elements, can form a complete room. These elements are provided with reinforcing ribs, of which same are so shaped that they can be used as supports for varied kinds of furniture, with clearance for windows and doors, as well as with channels for pipes and electric wires. They are also provided with means for mutual fixing of the elements to form a self supported assembly of rooms (U.S. Pat. No. 4,010,579).

A set of self supported prefabricated elements for modular housing construction is also known. This set consists of three basic elements, of variable sizes:

one inverted U shaped element, which represents the standard element for a room and it consists of two lateral walls and an overhead beam;

one inverted L shaped element, which represents a lateral wall and the ceiling and can be connected to the upper end of the lateral wall of the room; and a parallelipipedic box shaped cell element opened on the part of the floor and provided with a clearance for the entrance door (U.S. Pat. No. 4,228,623).

These structural elements have the disadvantage they are expensive to fabricate, require transportation from the place of fabrication to the site, use significant energy and manpower, and require numerous loading, unloading and handling devices for positioning and assembling.

A set of structural elements for construction which can make walls, floors, ceiling and connection parts is also known. A modular multifunctional element of said set consists of a cross-shaped part and a H-shaped part, wherein the longitudinally oriented joining plugs, as tongues of the cross-shaped part, are arranged above and below corresponding cavities or grooves of the H-shaped part. Besides, the transversely oriented, shorter arms of the cross-shaped parts end straight and just above the longer arms of said H-shaped part, namely in the middle portion thereof. The above mentioned, multifunctional element can also be designated as a closing element having a single plug, as a T-connection, having three plugs, as well as a cross-shaped connection having four plugs. Special embodiments of the multifunctional element are provided with pierced holes through which pass reinforcing bars (U.S. Pat. No. DE 2,110,563).

A disadvantage of this set of structural elements for construction is that the multifunctional element has a rather complicated and labor consuming structure both to manufacture and to use.

Another disadvantage is that the reinforcing bars do not have any suitable means for tension thereof and thus for obtaining wall strength increase on building site. Beside there are no means for reinforcing corner connections.

A disadvantage of other known structural elements consists in that the joining with horizontal or vertical expansion joints need hydroinsulation and thermal insulation, using for this purpose asbestos sheets, mineral wool covered with polyvinylchloride, porous rubber tape, aluminum sheets, elastic materials and plastics tapes, so increasing the material and manpower requirements and the cost price.

DISCLOSURE OF THE INVENTION

The object of the invention is to provide a construction set with a reduced number of structural elements to form self supporting space modules for housing construction and for other purposes, the elements of the set having such a shape, which to fulfil multiple functions of strength, joining and modularity, to be dismountable, for simple and fast assembly at low cost.

The set of structural elements for constructions, according to the invention, solves this technical problem and removes the aforesaid disadvantages in that it consists of a cubic modular element with a side length L, serving for the forming of corner and field poles. The set further consists of a multifunctional element obtained from the aforesaid cubic element and having the role of a brick and for obtaining other submodular building elements, meant for support and joining. The set further consists of a lintel with plugs for fixing the window and door frames, the modular element, the multifunctional element and the lintel as well as the submodular building elements being provided with pierced holes through which postcompression bars can be passed. The set further consists of a ceiling slab and a postcompression bar composed of segments. All the cubic modular elements are provided with pierced holes, four for example, which start from a face of the cube and open at the corresponding parallel face in a point which represents the intersection of the diagonals of some squares having their side length equal to L/3 and placed in each corner of the said surfaces. In half of the total number of modular elements, the other four faces are provided with three holes each, which are located one each in the center of each third part of the respective face, and in the other half of the total number of cubic elements the four aforesaid faces are provided with two holes each, located one in each of the marginal third part of the respective faces. The multifunctional element is pitchfork shaped and it is provided with a base and two lateral arms separated by a hole in a side and a slab positioned coaxially with the hole, in the opposite part, the arms, the hole and the slab being straight prisms with square base, having a side length=L/3 and its height L, each of them provided with a pierced hole, located at the intersection of the diagonals of their lateral faces, which determine the pitch fork configuration. The lintel 20 is a beam with rectangular transverse section having the height of a unit 1 where 1=L/3 and the width L at the inferior part and a series of prismatic plugs with length, width and height dimensions 1×1×L at the superior part its length being determined by the length of the window frame and ending, at the extremities, with a prismatic plug similar to those on the superior part. The lintel is postcompressed with two bars, by tightening them with nuts, which push a plate, and the prismatic plugs are each also provided with a pierced hole in their center of symmetry, through which a bar passes for postcompression and monolithizing with the brick from the wall. The ceiling slab is made of bricks and elements obtained from these, for example Z shaped straps and supporting bodies, joined by arms, plugs and gaps, ended at both extremities with plugs, and reinforced on their lateral sides with metallic rods, at the same time being pierced transversely and longitudinally by postcompression bars, which are tightened with nuts welded on the bars. Any other parts of different sizes and shapes, necessary for the structure, among which at least a Z shaped strap, a corner with a spur and supporting bodies having the form of quadrilateral prisms shall be obtained by partial or total detaching of one or more of the component parts of the multifunctional element by changing the angles between the faces and by modifying the dimensions and the ratio between them. The self supported structural space module, achieved with the set of structural elements for construction according to the present invention, consists of corner and field poles, walls and a ceiling made of ceiling slabs, all being provided with reinforcement. The corner and field poles are composed of the cubic modular elements. The walls are composed of brickwork including the multifunctional elements which are pitchfork shaped bricks and the submodular building elements which are Z shaped straps and supporting bodies. The walls can have window and door lintels, the ceiling slabs being formed of the pitchfork shaped bricks. All of the cubic modular elements, pitchfork shaped bricks, Z shaped straps and supporting bodies. The walls can have window and door lintels, the ceiling slabs being formed of the pitchfork shaped bricks. All of the cubic modular elements, pitchfork shaped bricks, Z shaped straps and supporting bodies being provided with plugs and gaps and assembled in a mutually supporting relationship. These elements as well as the ceiling slabs, which join with the walls also by plugs and gaps, being traversed in postcompression bars, vertically in the poles and horizontally in the brickwork and the ceilign slabs. These bars being tensioned from their extremities by a plate and a nut, the postcompression and consolidation of the structure being achieved by tightening the nuts which are afterwards welded to the respective bars.

The set of structural elements for construction, according to the invention, has the following advantages:

it is made of a reduced number of parts;

it occupies a limited storing space;

it needs only simple technical means for transport, handling and mounting;

it is adapatable to varied cosntructive configurations;

it has a large application field;

it can be assembled in a short period of time, easily and with unskilled manpower;

it reduces by at least one half the fabriction cost; and it permits dismantling and reusing of the components.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
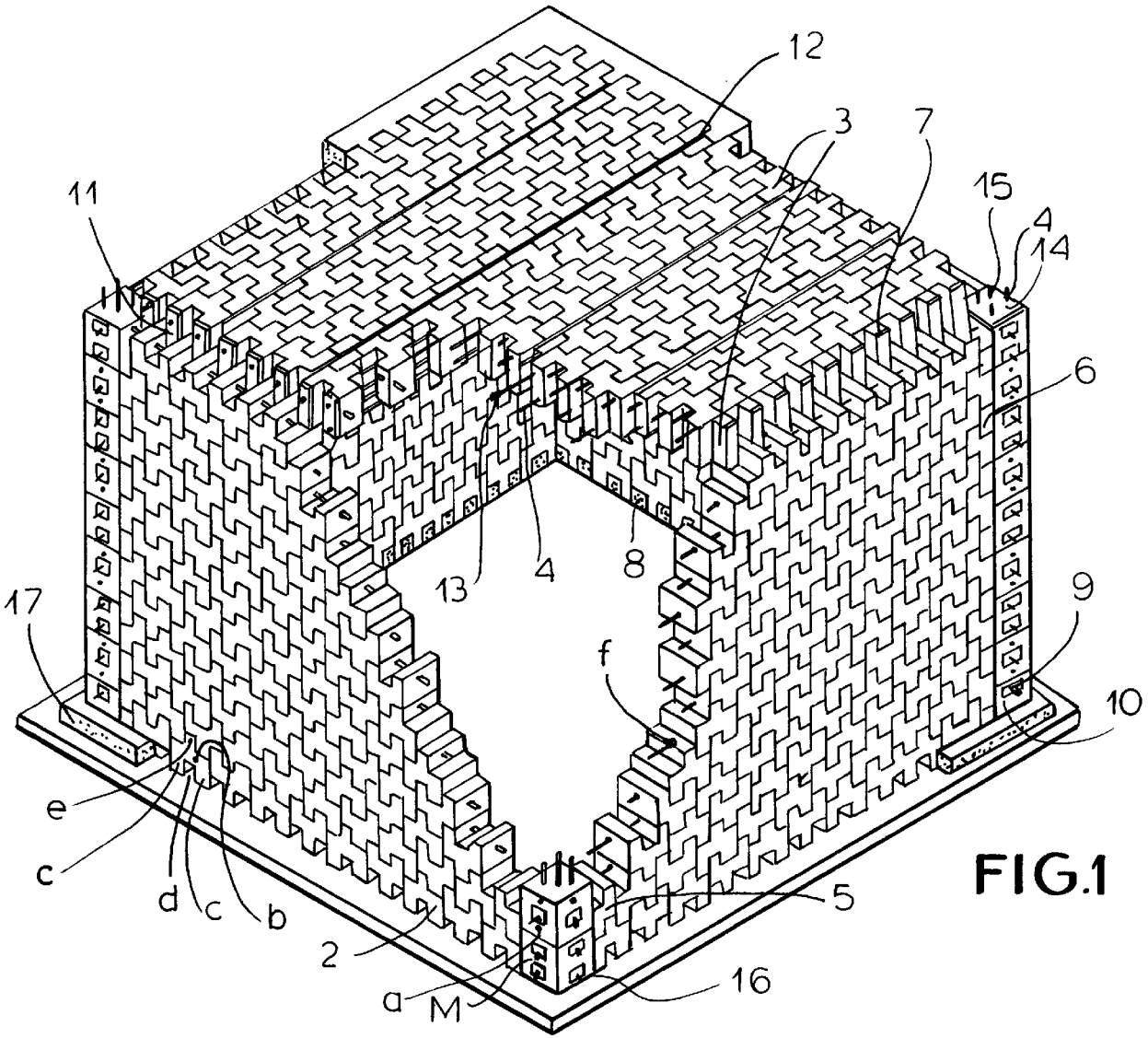
FIG. 1 is a diagrammatic perspective view showing the set of structural elements forming a self-supported construction module.
Figure 2:
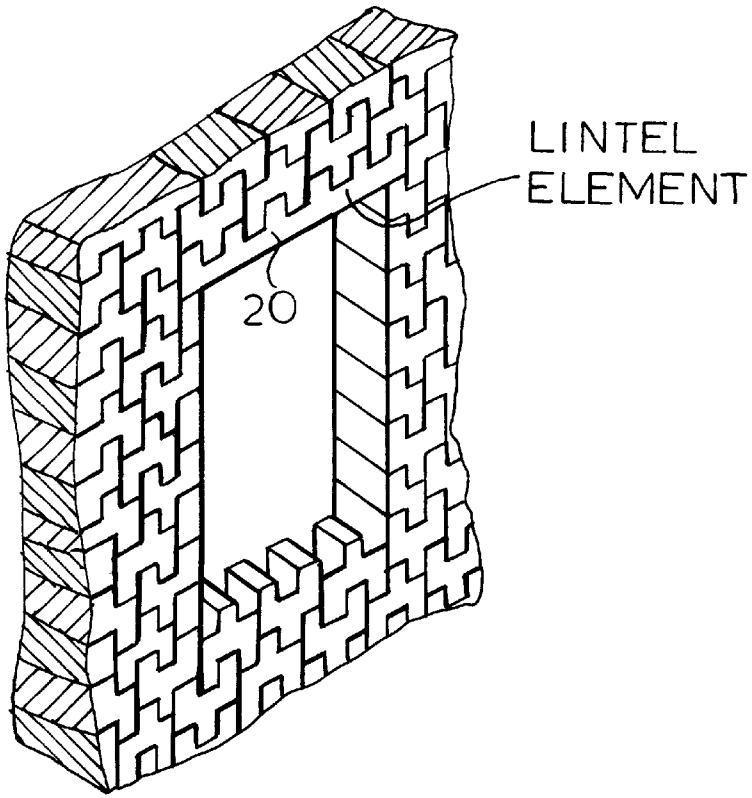
FIG. 2 is a section of such a module showing a window provided with a lintel element therein.
Figure 3:
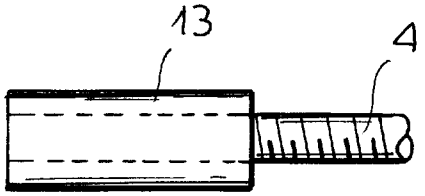
FIG. 3 is a detail showing the threaded sleeve.
Figure 4:
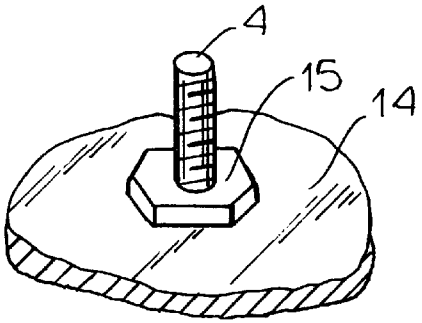
FIG. 4 is a detail showing a nut on one of the threaded rods.

The set is made of a moldular element M for forming the corner and field posts and a multifunctional element 2 for forming the brickwork. A window lintel with plugs can be used. The structure can include a ceiling 3. Bars 4 serve for postcompression.

The modular element M is a cube-shaped block with a side length L, in which there are pierced the holes a, parallel to the edges of the cube. Four of these holes from one face of the cube to the corresponding opposite parallel face, atthe intersection points of the diagonals of squares having side lengths equal to one submodule length=L/3, placed in each cornerof these faces. They serve for the passing of the vertical bars 4 meant for monolithizing the strength poles by postcompression. On the other faces there are formed either three pierced holes a, located in the symmetry center of the third parts of those faces, or two pierced holes located in the symmetry center of the marginal third parts. These holes serve with the passing of the horizontal bars 4 for monolithizing the walls by postcompression. The horizontal bars from the walls together with the vertical bars from the poles form a housing for reinforcing the self supported brickwork.

The multifunctional element 2 serve to form the walls between the posts and for formation of the ceiling slab.

The multifunctional element 2 is obtained from the block M from which on one of the face shall be removed two marginal units L/3×L/3×L, and on the opposed face shall be detached the same unit located in the central third part. The multifunctional element so obtained is pitchfork shaped, with a base b, two arms c, a gap d and a plug e, of which configuration derives from the detached parts.

On the lateral faces of the arms c and plug e there are holes f located in their symmetry center.

By detaching parts from the multifunctional element 2 shall be obtained elements with different configurations necessary in the brickworks as filling, fixing and supporting parts. So, by sectioning the base of the element 2 in a plane parallel to a lateral face of the plug e shall be obtained a strap 5 with inversed Z shaped arms and a supporting body 6, and by sectioning an arm e in a plan tangent to the bottom of the gap d shall be obtained a corner with spur 7. Also, by removing the arm c shall be obtained a body 8 for filling some gaps d from the base of the wall or from its superior part.

In a similar manner may be obtained other construction parts with variable configurations and sizes, by partial or total removal one of the parts b, c, e of the element 2 or by detaching parts from the cubic block M, by changing the angles, by changing the dimensions and the dimensional ratio between the parties. The lintel with plugs for the window, non-figurated, is composed of a beam with rectangular transversal section 1×L and a length determined by the lengthof the window cse, for example 6L+1. The inferior surface of the lintel is smooth and the superior surface presents a series of plugs e separated by gaps d, which determine at both the extremities a terminal plug. The lintel is pierced along its all length by two bars 4 which ensure the postcompression by tightening with the nuts 9 which push on the plates 10. In the symmetry center of each plug e from the superior part of the lintel is made a hole a with a view to postcompressing with a bar 4 and consolidating with the wall, after joining with bricks 2 from the brickwork.

By detaching from the aforesaid lintel of a portion from the beam with several plugs, three for example, it is obtained another lintel, a shorter one, of similar construction, for the door.

The floor slab 3 consits, along with its width, of two or three bricks for example, and along with its length, of the necessary number of bricks determined by the brath of the room. The bricks areranged with the arms c and the plugs e in the horizontal plane of the floor slab, successively alternating their orientation and combining them with Z shaped straps 5 and supporting bodies 6 in order to achieve an interpenetrating among the arms, plugs and gaps of the adjacent bricks and to obtain at both the extremities a succession of plugs separated by gaps which are to join with the corresponding plugs and gaps from the superior part of the brickwork. The bricks so positioned are traversed longitudinally and transversally by postcompression bars 4, which pass through the plates 11 located at the extremities and through the metallic rods 12 located on the flanks. The ceiling slab so assembled is submitted to the operation of postcompression by tightening the nuts at the ends of the bars, which are afterwards welded, so obtaining a caisson construction, strongly compressed.

The postcompression bar 4 is made of steel and it is threaded at its ends. It consists of sections with length convenient for mounting, about 1000 mm for example. These sections shall be assembled by means of the threaded sleeves 13 according to the length of a row of brick from the brickwork or as the height of a corner or field pillar increases. At the end of the bar assembly there is a plate 10, 11 or 14 and a nut 15.

For laying pipes and cables the brick with clearances with forms, sizes and oarientations adequated to the respective elements and the necessary routes, or these can be formed on site, because the special material DURREF permits this.

This material is a mould substitute which includes in the mixture as a vegetal component tree leaf particles, sawdust, rotten wood particles, splinters, paperwastes, roots, forage cultures, cereal crops, sorghum wastes, bark, stems, etc., included as mineral component, limestone in sulphate form, carbonates, calcium oxides, and a synthetic binder component of varied chemical sructure with or without dyes, which proportions are included by 35–60 by weight wooden or cellulosic particles 5–35 by weight limestone particles and between 5–30 by weight synthetic binders of varied harmless chemical structures with or without other additions as required by necessity.

The self supported module shall be mounted on a foundation slab, which shall be dimensioned, made horizontal and consolidated depending on the size of the module and the soil characteristics. The module rests upon the slab, without any tie with this.

After the geograhic orientation is established and the perimeter is set up on the foundation slab, the assembly can begin.

The execution starts by laying on the foundation slab of a block M for forming the corner poles and the field poles. These blocks from the base of the poles are of the type with two holes a on the lateral faces. They shall be layed by introducing the postcompression bars 4, which are welded on a fixing plate 16, through the four pierced holes a of each block. After positioning the blocks on the bars 4, the construction of the wall shall start by laying the first row of bricks between the poles. As first element of the first row, which is in contact with the corresponding lateral face of a cubic block M, may be a brick 2, a Z shaped strap 5 or a supporting body 6 so that it be achieved the condition of subsequent sowing between the arms c, plugs e and gaps d of the bricks which form the successive rows of the wall. If a brick 2 is mounted, laid for example with the arms c downward, then near it shall be layed on the slab another brick 2 with the arms c oriented upward, then another brick with the arms oriented downward, a.s.o., successively inverting the sense of the vertical laying of the bricks. In this case, when the number of the bricks between the holes is even, then the row shall end with a supporting body 6, having its height equal to two submodules 1. There are more possibilities of starting and ending of the brick rows of the brickwork.

The postcompression of the first row of bricks shall be made by using bars 4 assembled by sleeves 13. These bars shall be introduced through the horizontal holes a from the cubic bloc and according as new brick shall be added, they shall be introduced in the holes located in the arms and plugs of these. After introducing about three bricks the first threads sleeve shall be added, at the end of the hole, and a new bar 4, which continues to be passed through the holes according as new bricks are added. At the end of the first row and after the bars have been passed through all the bricks and the two poles, a plate 10 shall be introduced on the bars, at both ends, and the nuts shall be strongly tightened in order to achieve the monolithising of the bricks.

In the mentioned variant of the laying of the first row, the second row of the wall shall start with a strap 5 layed with the superior arm c rightward, this arm leaning on the base b of the first brick from the first row. Near this strap shall be layed the second brick with its arms orientated downward, it being followed by other brick oriented successively in a reverse sense till the end of the row.

The operations of postcompression with bars 4 shall be made as aforesaid, so achieving the consolidation of the first cubic block of the corner poles with the second row of bricks.

Further on, the second cubic block shall be introduced on the bars 4, but this block shall be provided with three pierced holes on each lateral face. There the third row of bricks shall be layed, proceeding the same way as in the first row, so achieving the consolidation between the second and third rows of bricks and the poles.

The third block of the corner and field poles shall have two holes, like the first one, the fourth block shall have three holes like the second one, a.s.o.

The operation shall be repeated in the same way till the laying of the last block 1 from the poles and the last row from the brickwalls including the zones of the door and window frames, where the lintels shall be mounted on supporting parts of varied forms.

In this moment the nuts of all bars 4 from the corner and field poles shall be tightened and welded, resulting a consolidated brickwork.

The erection shall continue with the laying of the floor slab 3 or the brickwork, introducing the plugs from their extremities in the gaps d from the last row of the brickwork. They shall lean only on a half of the thickness of the wall, so that the other half shall serve in achieving other joinings when the construction of two adjoining rooms is desired, using one of the walls as intermediary wall. These shall also be executed welded connections with steel strips between the reinforcement of the advancement floor slabs, as well as between floor slabs and the reinforcement of the corner and field poles. In this way a structure is obtained, consolidated by joinings which follow a labyrinth route so that the elements of the structure mutually support and block between them.

It is mentioned that depending on the strain to which the structure is submitted, the cubic block and the bricks from the brickwork may be assembled without a binding matter in case of some light constructions, submitted to low strains, or with a binding matter deposited or all the contact surfaces, in case of some big strains. This is a special binding matter DURREF, having a composition similar to the material used in the structure.

At the end of the assembling of the module a concrete girdle 17 shall be poured at the ceiling and the bare, which increase the strength of the construction and allow for the execution of other floors on the portant structure of the ground floor.

The execution of the self supported module shall be concluded by assembling the floor, which may be made either of the multifunctional elements 2 meant for a slab, or if DURREF slabs executed to this purpose, both types of elements being glued with DURREF binding matter on the foundation slab. The gaps d from the first row of bricks shall be filled with filling dies having the side of the frontal face equal to a submodule=L/3.

What is claimed is:

1. A set of structural elements for structures having walls and a ceiling, each element of said set consisting of a composition developed of wooden and cellulosic materials and a melamine or phenolformaldehyde binder and limestone particles, said elements including:

a modular element capable of being stacked to form corner posts of said structure and in the form of a cube of side length L having vertical holes and horizontal holes extending between opposite vertical faces;

a multifunctional element capable of being reversibly interfitted with other multifunctional elements to form said walls and ceiling and having a fork shape with two projections spaced apart by a gap on one side and a single projection on an opposite side, said multifunctional element having a height, length and width equal to L, said gap having a width equal to a projection width, said projections being traversed by horizontal holes;

a first submodular element having a central projection on one side and a single projection on an opposite side and having a height equal to L and a length and a width one of which being equal to ⅔ L and the other of which being equal to L;

a second submodular element having a general z shape with offset projections and having a height equal to L, a width equal to ⅔ L and a length equal to L, said projections being traversed by horizontal holes;

a lintel element having a length which is a multiple of L and projections of a width equal to ⅓ L; and bars adapted to extend through aligned holes of said elements and provided with nuts capable of being tightened to compress said elements together.

2. A set of structural elements as defined in claim 1 wherein said modular element has four vertical holes inwardly of respective corners of the respective modular element and located at intersections of diagonals of squares of side lengths 1=L/3.

3. A set of structural elements as defined in claim 2 wherein said modular element have two vertical interfaces traversed by two holes along a respective vertical symmetry plane and two other vertical faces traversed by three holes along a respective symmetry plane.

4. A set of structural elements as defined in claim 3 wherein said holes in said projections are each located at the intersection of diagonals of said projections, each projection extending ⅓ of the length L.

5. A rectangular parallelipipedic structure composed of the elements defined in claim 1 elements and said bars and formed with said walls and said ceiling.

* * * * *